United States Patent [19]

Wallis

[11] 3,942,455

[45] Mar. 9, 1976

[54] INCINERATOR AND METHOD

[76] Inventor: Keith H. J. Wallis, 4901 Carmel Club Drive, Charlotte, N.C. 28211

[22] Filed: Oct. 29, 1974

[21] Appl. No.: 518,703

[52] U.S. Cl. ..... 110/8 C; 110/14; 110/44 D; 110/110

[51] Int. Cl.[2] ..... F23G 5/12; F23K 3/14

[58] Field of Search ..... 110/8 R, 11, 14, 44 R, 110/44 B, 110, 8 C

[56] References Cited

UNITED STATES PATENTS

| | | | |
|---|---|---|---|
| 970,660 | 9/1910 | Stineman | 110/110 X |
| 1,340,274 | 5/1920 | Kelly | 110/44 |
| 2,932,712 | 4/1960 | Levin | 110/110 X |
| 3,472,185 | 10/1969 | Burden, Jr. | 110/110 |
| 3,774,555 | 11/1973 | Turner | 110/11 |
| 3,861,336 | 1/1975 | Koyanagi et al. | 110/14 |

*Primary Examiner*—Kenneth W. Sprague
*Attorney, Agent, or Firm*—Parrott, Bell, Seltzer, Park & Gibson

[57] ABSTRACT

Combustible debris is burned in an incinerator which has a screw conveyor penetrating a combustion chamber for moving debris therethrough. Burning of debris is initiated near one end of the combustion chamber and air for combustion is delivered through the screw conveyor and distributed throughout the chamber for assuring completion of combustion as debris is moved through the chamber.

12 Claims, 7 Drawing Figures

Fig-7
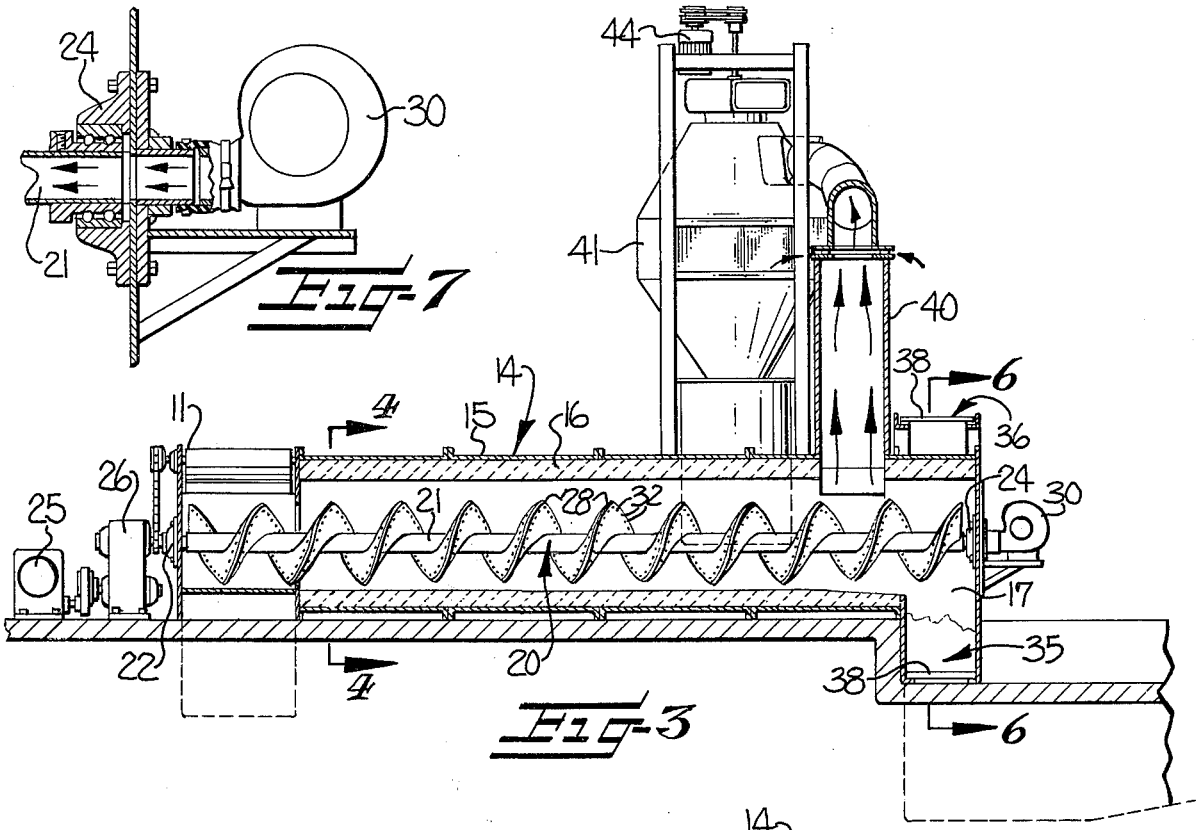
Fig-3
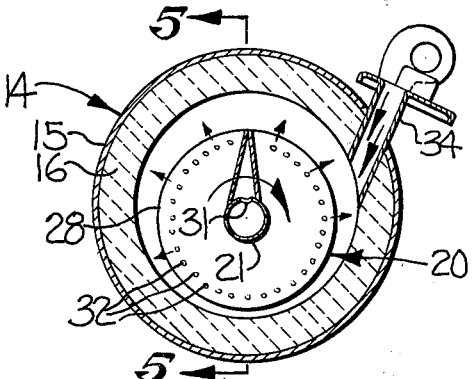
Fig-4
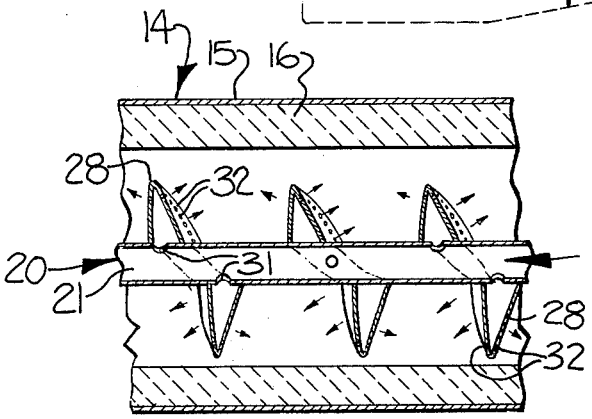
Fig-5
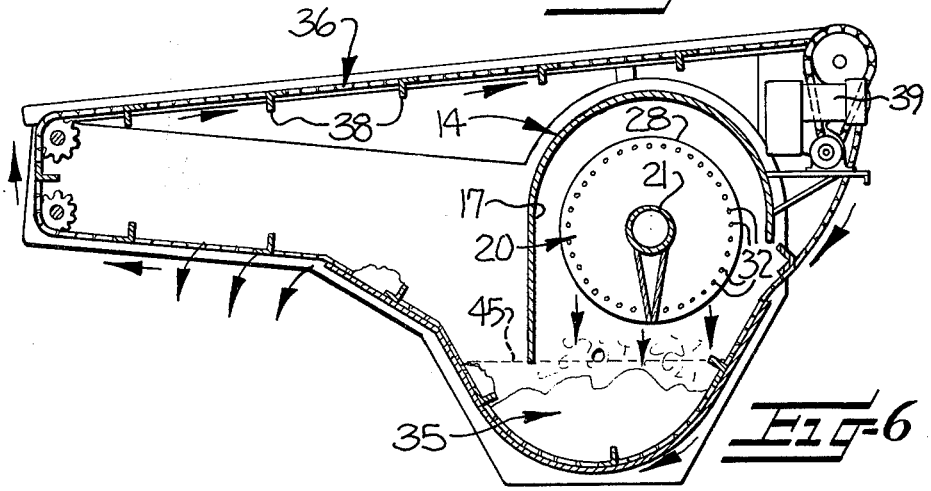
Fig-6

INCINERATOR AND METHOD

Incinerators and sanitary land fills have heretofore been two of the solutions used for the problem of disposing of debris. With some materials to be disposed of, incinerators have been satisfactorily operated using techniques by which the air supplied for combustion is reduced to control temperature conditions and rates of combustion so as to entirely consume debris. In other circumstances, such "starved air" incinerators are ineffective and reliance has been placed upon conventional sanitary land fill techniques as used in the disposal of household garbage and the like.

While it has been recognized that household garbage is difficult to dispose of by burning, due to the frequently wet or soggy nature of that debris, it has also been recognized that such debris contains noncombustible materials possibly subject to recycling or reuse, such as metal cans and the like. Additionally, land available for sanitary land fill use is limited, adding to the desirability of incineration as an alternative.

With the above background in mind, it is an object of this invention to accomplish incineration of debris in accordance with a method and through the use of an apparatus adapted for handling household garbage and similar wet debris which has heretofore presented major problems. In realizing this object of the present invention, a screw conveyor is provided for moving debris through a combustion chamber as burning of the debris takes place.

Yet a further object of this invention is to assure continuing combustion of debris as the debris is moved through an elongate chamber, while maintaining the possibility of recovering noncombustible solid materials for possible recycling or reuse. In accomplishing this object of the present invention, air in excess of the quantities required for combustion of the debris is delivered through the screw converyor and is distributed throughout the combustion chamber. Inasmuch as the screw conveyor moves the debris through the combustion chamber, delivery of air for combustion through the conveyor assures that combustion occurs through as much of the chamber as is required to complete burning of the combustible materials included in the debris. Further, the use of excess air aids in facilitating complete disposal of the combustible portion of the debris while accommodating delivery of noncombustible debris for subsequent segregation and reuse.

Some of the objects of the invention having been stated, other objects will appear as the description proceeds, when taken in connection with the accompanying drawings, in which —

FIG. 3 is an elevation view, partly in section, taken generally along the line 3—3 in FIG. 1;

FIG. 4 is an enlarged sectional view taken generally along the line 4—4 in FIG. 3;

FIG. 5 is an enlarged sectional view generally similar to FIG. 3, taken generally along the line 5—5 in FIG. 4;

FIG. 6 is a sectional view taken generally along the line 6—6 in FIG. 3; and

FIG. 7 is an enlarged elevation view, partially in section, showing a portion of the incinerator as shown in FIG. 3.

Figures 1, 2:
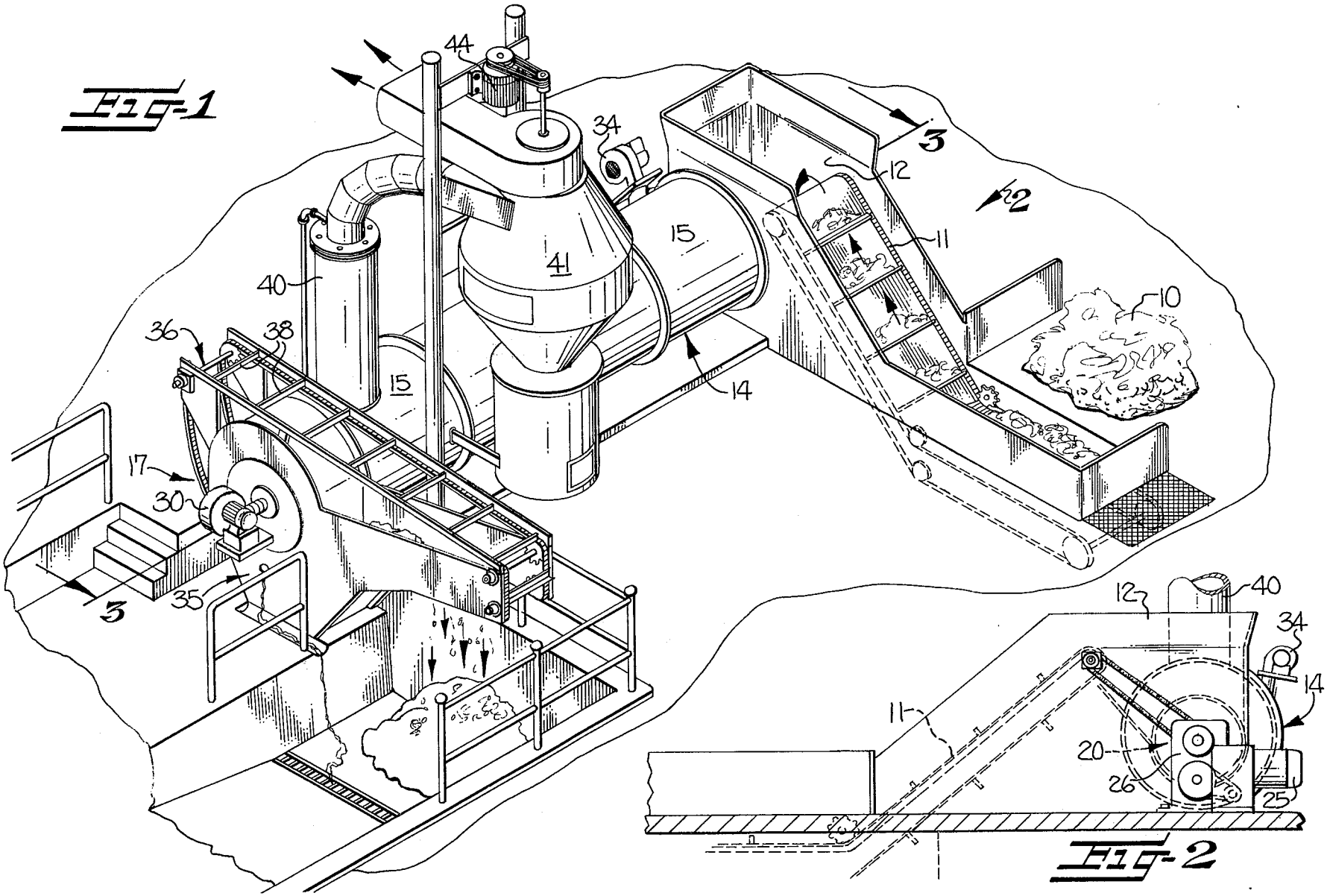
FIG. 1 is a perspective view of an incinerator in accordance with the present invention.
FIG. 2 is an end elevation view of the incinerator of FIG. 1, taken generally as indicated by the arrow 2 in that figure.

While the accompanying drawings and the description which follows will be directed particularly to the best mode of this invention shown at the time that the drawings and description were prepared, it is to be recognized at the outset that the persons knowledgeable in the construction and operation of incinerators will be able to apply the principal of this invention to arrangements and operations other than those specifically illustrated and described. Accordingly, it is contemplated that the illustration and description be understood broadly, and not as restricting on the scope of the present invention.

Referring now more particularly to the accompanying illustrations, an overall view of the apparatus of this invention may be gained by reference to FIG. 1, in which incoming debris to be incinerated, generally indicated at 10, is shown as being delivered into a pit or the like and fed by a lift conveyor 11 into a hopper 12 at an entrance end of an elongate combustion chamber means generally indicated at 14. It will be understood that other arrangements are comtemplated and may be provided for the introduction of such debris into the entrance end of the combustion chamber 14.

As is made more clear from the sectional views, the combustion chamber 14 preferably defines a generally right circular cylindrical volume and may be formed by a generally tubular metallic wall 15 lined with a suitable refractory material 16. The chamber 14 has an exit end generally indicated at 17, remote from the entrance end adjacent the hopper 12. In accordance with important features of this invention, a screw conveyor means generally indicated at 20 penetrates into the chamber means 14 for moving debris therethrough. The screw conveyor means 20 takes the form of an elongate hollow shaft means 21 mounted for rotation within the chamber 14, as by means of an entrance end bearing 22 and an exit end bearing 24. Drive means, illustrated as taking the form of an electrical drive motor 25 and a suitable gearing transmission 26 (FIGS. 2 and 3), is provided for rotating the shaft 21. As is generally known for screw conveyors, a thread means 28 is spiraled about the shaft 21 for engaging debris upon rotation of the shaft and thereby for moving engaged debris from the hopper 12 through the combustion chamber 14 to the exit end 17 of the incinerator.

As will be noted from FIGS. 3–5, the screw conveyor means 20 is supported for rotation about an axis offset from the central axis of the generally right circular cylindrical volume of the combustion chamber 14. Such an offset provides a clearance volume which is greater to one side of the screw conveyor (above the conveyor in the embodiment illustrated) for receiving noncombustible debris of sizes otherwise possibly jamming the conveyor during operation of the incinerator. Additionally, the thread 28 spiraled about the shaft 21 has a sloped configuration to one side and a generally straight configuration to the other side, so as to better engage and move the debris being incinerated.

In accordance with further important features of this invention, air is delivered through the screw conveyor 20 into the combustion chamber 14 for combustion with debris moving therethrough. In particular, fan means generally indicated at 30 is provided and operatively communicates with the hollow shaft 21 for directing air flow thereinto (FIGS. 5 and 7). By means of air flow openings 31 longitudinally spaced apart along the shaft 21 (FIG. 5), air flowing through the shaft 21 is distributed into the thread 28. Such air flow then passes through openings 32 formed in the axially directed faces of the thread 28 to impinge onto debris engaged by the thread and assures combustion of that debris as described more fully hereinafter.

In view of the delivery of air for combustion through the screw conveyor in accordance with this invention, the present invention operates by initiating combustion of debris as the debris is fed into the combustion chamber 14. In the embodiment illustrated, this initiation of combustion occurs by means of a burner 34 mounted adjacent the entrance end of the combustion chamber 14. For convenience, the burner 34 preferably is a conventional gun type burner of the type used in known fuel oil, natural gas or propane furnaces, and is operated substantially continuously during operation of the incinerator of this invention. As indicated, the function of the burner 34 is to initiate combustion, which then continues as debris moves through the elongate chamber 14.

At the exit end 17 of the incinerator of this invention, both solid and gaseous effluent are discharged. In order to accommodate possible segregation and reuse of noncombustible debris such as metal cans and the like, an ash pit means generally indicated at 35 is provided, into which solid effluent falls. By means of a chain conveyor generally indicated at 36 having spaced apart push bars 38 and driven by an appropriate drive means 39, solid effluent is removed from the ash pit 35 and discharged from the incinerator of this invention for such subsequent handling as is deemed necessary or appropriate.

Gaseous effluent is drawn from the combustion chamber 14 through a stack 40 and into a cyclonic separator 41 under draft induced by a draft fan 42 driven by an appropriate drive means 44. In conjunction with the use of the cyclonic separator 41, a wet scrubbing effect is achieved by delivering running water into the stack 40, which water drains into the ash pit 35. A body of water 45 collected there forms a liquid seal for the exit end 17 of the incinerator of this invention.

While a cyclonic separator is shown in the accompanying illustration as a means for cleaning gaseous effluent from the combustion chamber and discharging the clean gaseous effluent into the ambient atmosphere, persons familiar with the control of air pollution will understand both the desirability of some provisions for cleaning gaseous effluent and the range of alternatives available for consideration in achieving that function.

In the drawings and specification, there has been set forth a preferred embodiment of the invention, and although specific terms are employed, they are used in a generic and descriptive sense only and not for purposes of limitation.

That which is claimed is:

1. An incinerator for burning combustible debris and comprising elongate combustion chamber means having an entrance end for receiving debris and an exit end for discharging effluent, burner means adjacent said entrance end for igniting debris received into said chamber means, hollow screw conveyor means extending through the length of said chamber means for moving debris therethrough, and fan means operatively communicating with said screw conveyor means for impelling air flow therethrough, said screw conveyor means and said fan means cooperating for distributing throughout the length of said chamber means air in excess of that required for burning ignited debris so as to facilitate complete incineration thereof as such debris is moved through said chamber means.

2. An incinerator according to claim 10 wherein said screw conveyor means comprises an elongate hollow shaft means mounted for rotation within said chamber means and penetrated by longitudinally spaced apart air flow openings, drive means for rotating said shaft means, and thread means spiraled about said shaft means for engaging debris upon rotation of said shaft means and thereby for moving engaged debris.

3. An incinerator according to claim 2 wherein said thread means defines a hollow interior operatively communicating with said shaft means for receiving airflow distributed therealong and for directing air flowing into said chamber means to impinge onto debris engaged by said thread means.

4. An incinerator according to claim 2 wherein said chamber means defines a generally right circular cylindrical volume and further wherein said shaft means is mounted for rotation about an axis offset from the central axis of said volume for facilitating passage through said chamber means of noncombustible solid debris.

5. An incinerator according to claim 1 further comprising hopper means adjacent said entrance end of said chamber means for feeding debris thereinto.

6. An incinerator according to claim 1 further comprising ash pit means adjacent said exit end of said chamber means for receiving solid effluent therefrom.

7. An incinerator according to claim 1 further comprising gas cleaning means operatively communicating with said exit end of said chamber means for receiving gaseous effluent therefrom and for cleaning such gaseous effluent.

8. An incinerator according to claim 1 wherein said chamber means defines a generally horizontally disposed right circular cylindrical volume for containing burning debris.

9. A screw conveyor means for moving debris through an elongate combustion chamber while delivering air for combustion of the debris and comprising an elongate hollow shaft means mounted for rotation and penetrated by longitudinally spaced apart air flow openings, drive means for rotating said shaft means, thread means spiraled about said shaft means for engaging debris upon rotation of said shaft means and thereby for moving engaged debris, and fan means operatively communicating with said shaft means for impelling air flow therethrough, said thread means defining a hollow interior operatively communicating with said shaft means for receiving air flow impelled therethrough and for directing air to impinge onto debris engaged by said thread means and cooperating with said shaft means and said fan means for distributing air flowing through said shaft means therealong and thereby facilitating combustion of debris moved by said conveyor means.

10. A method of burning combustible debris comprising igniting debris fed into an elongate combustion chamber, moving the ignited debris through the chamber with a hollow rotating screw conveyor which extends through the length thereof, and impelling through the conveyor air in excess of that required for combustion of the debris while distributing the air throughout the length of the chamber.

11. A method according to claim 10 wherein the delivering of air includes supplying an excess of air over the minimum required for combustion and distributing the air throughout the elongate chamber for continuing burning of debris as the debris moves through the chamber.

12. A method according to claim 10 further comprising receiving in an ash pit solid effluent from the chamber while cleaning gaseous effluent from the chamber and discharging cleaned gaseous effluent into the ambient atmosphere.

* * * * *

UNITED STATES PATENT AND TRADEMARK OFFICE

CERTIFICATE OF CORRECTION

PATENT NO. : 3,942,455

DATED : March 9, 1976

INVENTOR(S) : Keith H. J. Wallis

It is certified that error appears in the above-identified patent and that said Letters Patent are hereby corrected as shown below:

Column 1, Line 38, correct the spelling of "conveyor";
Column 4, Line 3, correct "Claim 10" to read --Claim 1--

Signed and Sealed this

*first* Day of *June 1976*

[SEAL]

*Attest:*

RUTH C. MASON
*Attesting Officer*

C. MARSHALL DANN
*Commissioner of Patents and Trademarks*